US010823483B1

(12) United States Patent
Baylor et al.

(10) Patent No.: US 10,823,483 B1
(45) Date of Patent: Nov. 3, 2020

(54) REFRIGERATOR APPLIANCE WITH HEAT TRANSFER FEATURES FOR REDUCING CONDENSATION

(71) Applicant: Haier US Appliance Solutions, Inc., Wilmington, DE (US)

(72) Inventors: Stephen Michael Baylor, Evansville, IN (US); Martin Rodney Busche, Evansville, IN (US); Ronald Kenneth Anderson, Sidney, OH (US); Nasser Mehrnia, Newburgh, IN (US); Zachary Michael Eagleson, Newburgh, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/653,187

(22) Filed: Oct. 15, 2019

(51) Int. Cl.
*F25D 21/04* (2006.01)
*F25D 23/02* (2006.01)

(52) U.S. Cl.
CPC ..... *F25D 21/04* (2013.01); *F25D 23/028* (2013.01)

(58) Field of Classification Search
CPC ..... F25D 21/04; F25D 21/065; F25D 23/028; F25D 23/10; F25D 2321/00; F25D 2323/02; F25D 2400/34; F25D 2600/04
See application file for complete search history.

(56) References Cited

U.S. PATENT DOCUMENTS 2,449,384 A * 9/1948 Hursey ..... F25D 21/04 62/277
3,055,193 A * 9/1962 Smith ..... E05C 19/161 62/440
3,157,306 A * 11/1964 Courson ..... F25D 23/062 312/405
3,254,503 A * 6/1966 Rundell ..... F25D 21/04 62/275
4,317,516 A * 3/1982 Palmer-Ball, Sr. ..... E05B 15/1607 206/320
9,010,956 B1 4/2015 Davis
9,080,808 B2 7/2015 Choi et al.
9,605,842 B1 3/2017 Davis
2008/0209812 A1* 9/2008 Lancry ..... F25D 21/04 49/316
2015/0330678 A1* 11/2015 Hu ..... F25C 5/22 62/3.6

FOREIGN PATENT DOCUMENTS

CN 104990339 A * 10/2015
DE 102005002151 A1 * 7/2006 ..... F25D 21/04
DE 102007008707 A1 * 8/2008 ..... F25D 23/087
DE 102007062024 A1 * 6/2009 ..... F25D 23/069
(Continued)

*Primary Examiner* — Andrew M Roersma
(74) *Attorney, Agent, or Firm* — Dority & Manning, P.A.

(57) ABSTRACT

A refrigerator appliance includes a liner positioned within a cabinet and a mullion positioned within the liner to define a fresh food chamber and a freezer chamber. One or more doors provide selective access to these chambers and are covered by an appearance panel, such as a cabinetry panel. An air pocket is defined between the appearance panel and the liner or mullion, and a heat transfer feature is positioned within the air pocket for increasing a surface area for thermal energy transfer, thereby reducing cool spots and potential condensation within the air pocket or on surfaces defining the air pocket.

18 Claims, 5 Drawing Sheets

(56) References Cited

FOREIGN PATENT DOCUMENTS

| | | | | | |
|---|---|---|---|---|---|
| FR | 2802787 | A3 | * | 6/2001 | ..... F25D 23/028 |
| JP | H10292969 | A | | 11/1998 | |
| JP | H11166787 | A | | 6/1999 | |
| JP | 2004085034 | A | * | 3/2004 | |
| JP | 2011185490 | A | * | 9/2011 | |
| JP | 2017180875 | A | | 10/2017 | |

* cited by examiner

REFRIGERATOR APPLIANCE WITH HEAT TRANSFER FEATURES FOR REDUCING CONDENSATION

FIELD OF THE INVENTION

The present subject matter relates generally to refrigerator appliances, and more particularly to features for reducing condensation within a refrigerator appliance.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

It is common for typical refrigerators stick out from a wall or cabinet in which they are installed. In order to address this concern, certain refrigerator appliances, such as those commonly referred to as built-in refrigerators, are configured to be installed in a cabinet such that a refrigerator appliance appears to be an integral part of the kitchen or room. In addition, to improve aesthetics, the refrigerator doors of these built in refrigerators are configured for receiving a cabinet panel such that the appliance blends in with adjacent cabinetry. However, such cabinetry panels are typically made from wood or another insulative material, thus changing the way air flows in and around the front of the appliance. For example, decorative panels may trap cool air between the door seals and the cabinetry panel, resulting in a region prone to condensation, which may cause mold, mildew, or musty smells.

Accordingly, a refrigerator appliance with features that reduce undesirable condensation be useful. More particularly, heat transfer features for use in a refrigerator appliance to reduce cool regions and the likelihood of condensation would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance defining a vertical direction, a lateral direction, and a transverse direction is provided. The refrigerator appliance includes a cabinet, a liner positioned within the cabinet to define a chilled chamber, and a door mounted to the cabinet and being movable between an open position and a closed position to provide selective access to the chilled chamber. An air pocket is defined between the door and the liner and a heat transfer feature positioned within the air pocket for increasing a surface area for thermal energy transfer.

In another exemplary aspect of the present disclosure, a door assembly for a refrigerator appliance is provided. The refrigerator appliance includes a liner defining a chilled chamber and the door assembly includes an insulated door frame mounted to the cabinet and being movable between an open position and a closed position to provide selective access to one of the chilled chamber, an appearance panel mounted to a front of the insulated door frame, an air pocket defined between the appearance pane, the insulated door frame, and the liner, and a heat transfer feature positioned within the air pocket and comprising heat exchange fins for increasing a surface area for thermal energy transfer.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
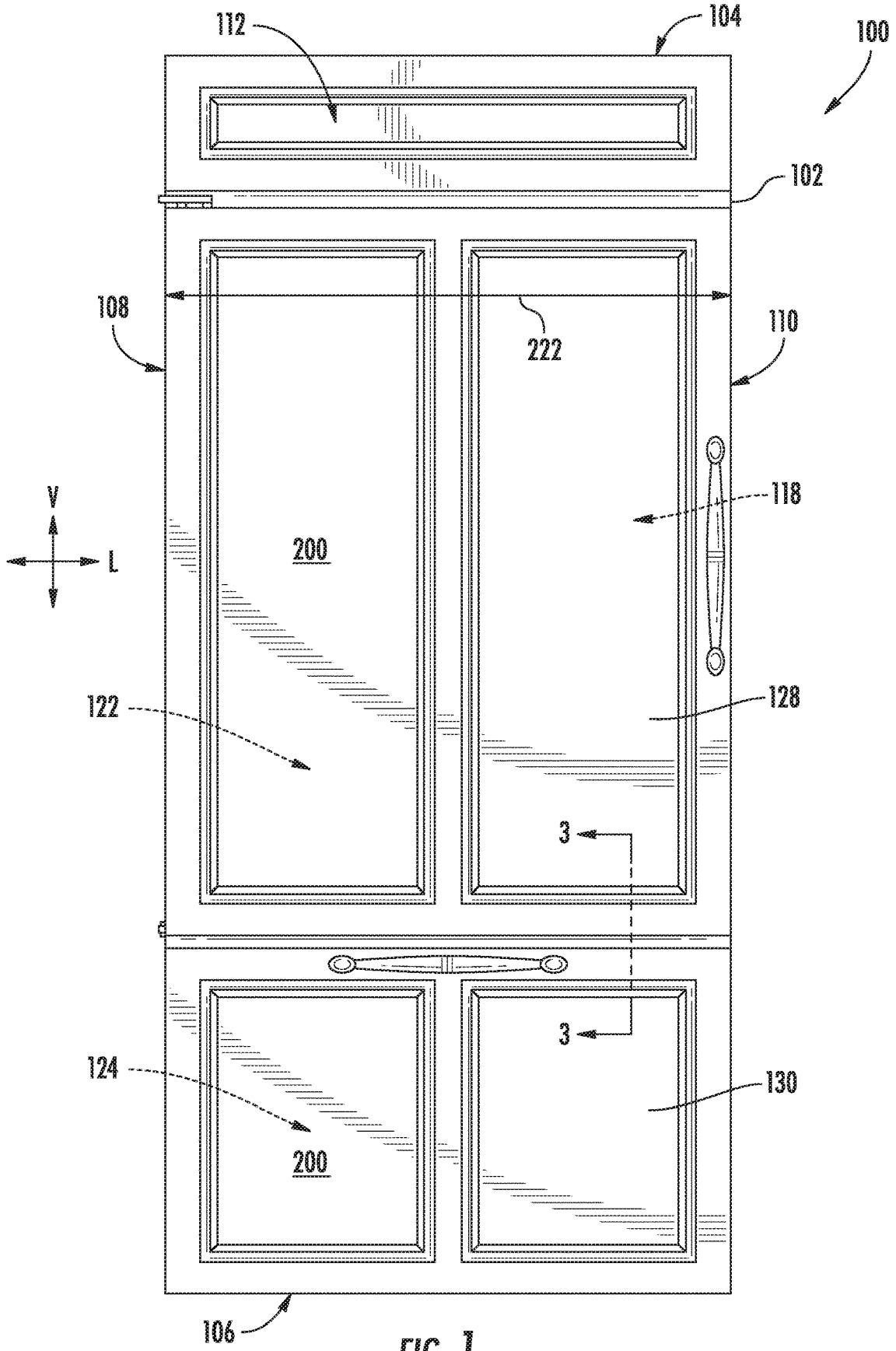
FIG. 1 provides an elevation view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Terms such as "inner" and "outer" refer to relative directions with respect to the interior and exterior of a refrigerator assembly. For example, "inner" or "inward" refers to the direction towards the interior of the refrigerator appliance. Terms such as "left," "right," "front," "forward," "back," "rearward," "top," or "bottom" are used with reference to the perspective of a user accessing the refrigerator appliance. For example, a user stands in front of the refrigerator to open the doors and reaches into the chilled chamber(s) to access items therein.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Figure 2:
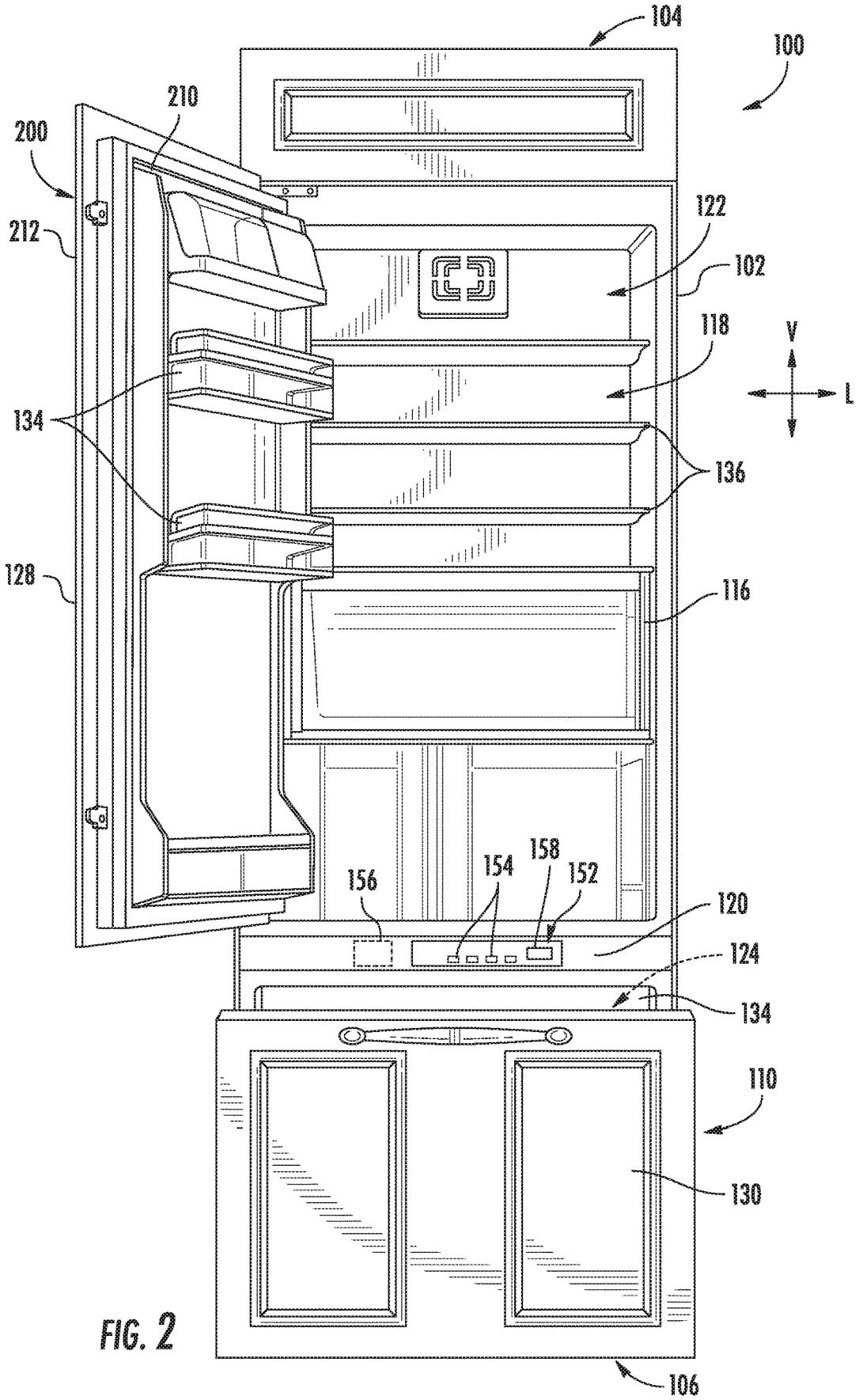
FIG. 2 provides an elevation view of the exemplary refrigerator appliance of FIG. 1 according to exemplary embodiments of the present disclosure, with the refrigerator and freezer doors in the open position.

Refrigerator appliance 100 further includes a liner 116 that is typically positioned within and lines the interior of cabinet 102. More specifically, liner 116 is typically an insulated liner, e.g., such that it is spaced apart from cabinet 102 and the space therebetween is filled with an insulating foam or other suitable insulating material. As best shown in FIG. 2, liner 116 generally defines one or more chilled chambers, referred to herein generally by reference numeral 118, for receiving food items for storage. Specifically, according to the illustrated embodiment, liner 116 surrounds an interior surface of cabinet 102 and refrigerator appliance 100 further includes a mullion 120 that divides chilled chamber 118 into multiple chambers.

Specifically, according to the illustrated embodiment, mullion 120 is an extension of liner 116, extends along the horizontal direction H, and is similarly insulated. In this manner, mullion 120 divides chilled chamber 118 into a first chamber, e.g., a fresh food chamber 122, and a second chamber, e.g., a freezer chamber 124, within cabinet 102. In this regard, fresh food chamber 122 is positioned at or adjacent top 104 of cabinet 102 and freezer chamber 124 is arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance.

Refrigerator appliance 100 may further include one or more refrigerator doors 128 that are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1 and in the open configuration in FIG. 2. One skilled in the art will appreciate that other chamber and door configurations are possible and within the scope of the present invention.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

A control panel 152 is provided for controlling the mode of operation. For example, control panel 152 includes one or more selector inputs 154, such as knobs, buttons, touch-screen interfaces, etc. In this regard, inputs 154 may be in communication with a processing device or controller 156. Signals generated in controller 156 operate refrigerator appliance 100 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate various components or subsystems of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now also to FIGS. 3 through 6, door assemblies 200 that may be used with refrigerator appliance 100 will be described according to exemplary embodiments of the present subject matter. For example, door assemblies 200 may replace one or both of refrigerator door 128 and freezer door 130. In describing these figures, like reference numerals may be used to refer to the same or similar features as described above with respect to refrigerator appliance 100.

As explained above, door assembly 200 (e.g., whether replacing refrigerator door 128 or freezer drawer 130) is mounted to cabinet 102 either by hinges or drawer slides such that it is movable between an open position and a closed position to provide selective access to fresh food chamber 122 or freezer chamber 124. All door assemblies 200 are illustrated in the closed position in FIGS. 3 through 6 and are sealed with liner 116 and/or mullion 120 by a gasket 202. For example, gasket 202 may be a resilient rubber gasket mounted onto door assembly 200 for engaging liner 116, mullion 120, or cabinet 102 when door assembly 200 is in the closed position.

As shown, door assemblies 200 generally include an insulated door frame 210 and an appearance panel 212 that is mounted to a front 214 of insulated door frame 210. As explained above, appearance panel 212 may generally be a cabinetry panel intended to blend the appearance of refrigerator appliance 100 into a bank of cabinets. In addition, appearance panel 212 is typically made from wood or another relatively insulating material. As such, cool air may be trapped in locations behind appearance panel 212, thereby forming regions that are prone to condensation, mold, mildew, and musty spells. Aspects of the present subject matter are directed to reducing such cool zones and the potential generation of condensation.

Figure 3:
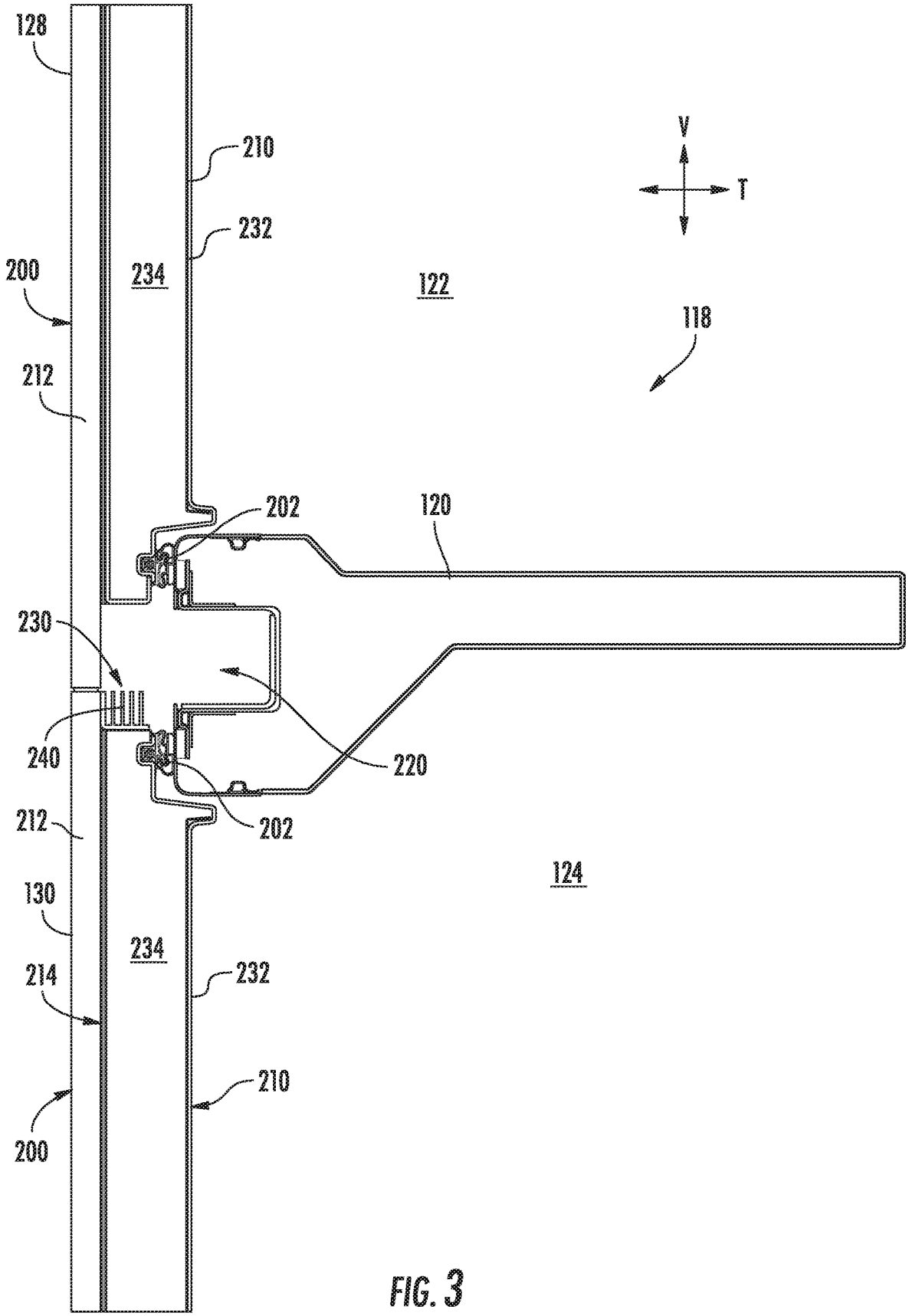
FIG. 3 provides a section view of a door assembly taken along Line 3-3 of the exemplary refrigerator appliance of FIG. 1, including a heat transfer feature according to an exemplary embodiment of the present subject matter.
Figure 5:
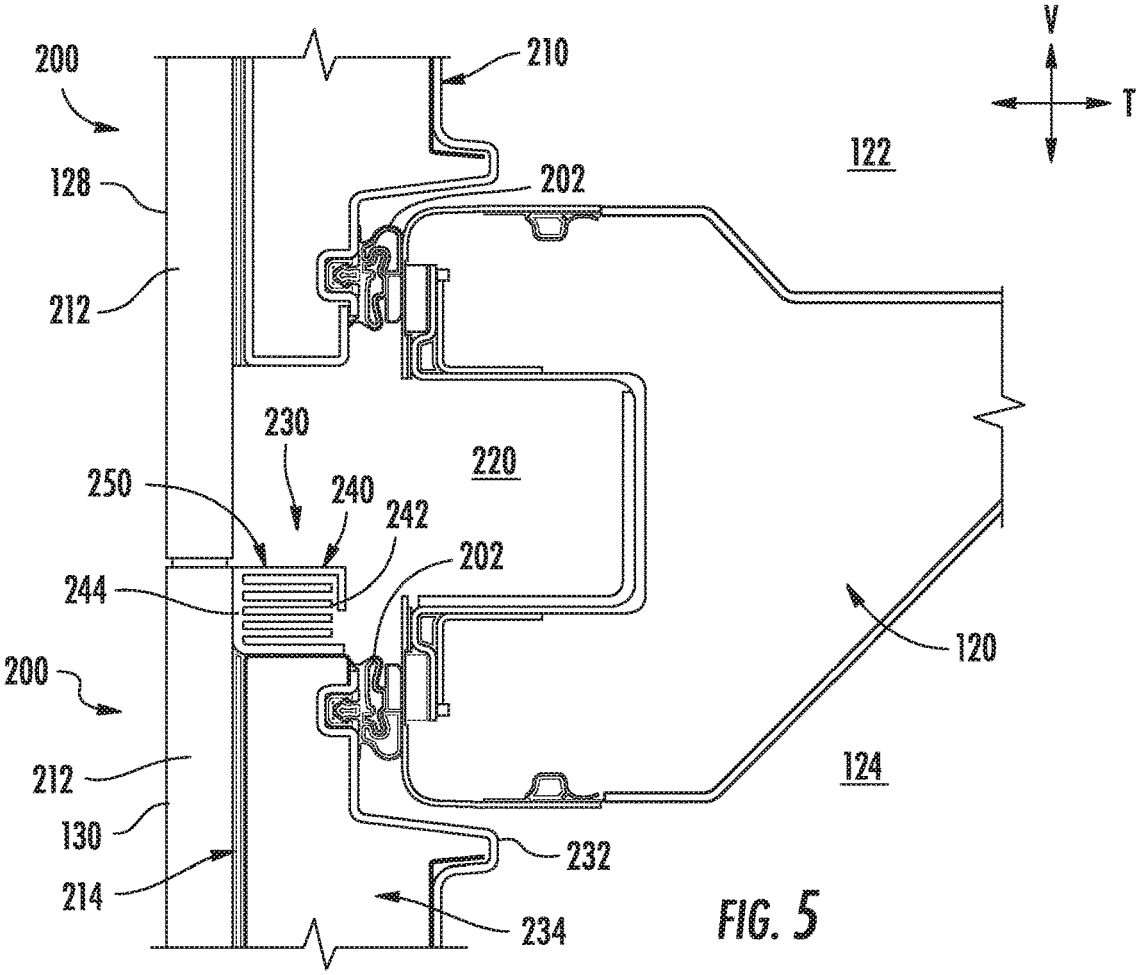
FIG. 5 provides a section view of a door assembly taken along Line 3-3 of the exemplary refrigerator appliance of FIG. 1, including a heat transfer feature according to another exemplary embodiment of the present subject matter.

Notably, as best illustrated in FIGS. 3 and 5, refrigerator appliance 100 may generally define an air pocket 220 between door assembly 200 and cabinet 102 or liner 116. In this regard, air pocket 220 is bounded on the front side by appearance panels 212, on the rear side by mullion 120, and on the top and bottom sides by mullion 120, gasket 202, and insulated door frame 210. Air pocket 220 may also extend along a width 222 (see FIG. 1) of door assembly 200 or even around the entire perimeter of door assembly 200. Notably, because appearance panel 212 provides a thermal break between air pocket 220 and the ambient environment, cool air from chilled chambers 118 may enter air pocket 220 and become trapped, resulting in cool surfaces that may result in condensation.

According to exemplary embodiments, refrigerator appliance 100, and more specifically door assembly 200, includes one or more heat transfer features 230 that are positioned within air pocket 220 for reducing the temperature therein. Specifically, heat transfer features 230 are formed from a thermally conductive material, such as copper, stainless steel, or aluminum, and are is designed to have a large surface area for improving thermal energy transfer from the air within air pocket 220. For example, according to the illustrated embodiment, insulated door frame 210 includes a metal outer panel 232 filled with insulation 234. As illustrated, heat transfer features 230 are mounted in direct thermal contact with outer panel 232 such that heat may transfer from outer panel 232, into heat transfer features 230, and into air pocket 220. In this manner, the temperature within air pocket 220 may be raised above a dewpoint to prevent potential condensation.

According to an exemplary embodiment, heat transfer features 230 are heat sinks 240 that include a plurality of elongated heat exchange fins 242. In general, heat exchange fins 242 extend from a base plate 244 into air pocket 220 to increase the surface area available for thermal energy transfer. According to the embodiment illustrated in FIGS. 3 and 4, base plate 244 is mounted directly to a mounting surface 246 defined on a top side of the door frame 210. It should be appreciated that thermal paste may be used to increase the thermal contact between base plate 244 and door frame 210. According to this embodiment, heat exchange fins 242 extend substantially along the vertical direction V (e.g., within a plane defined by the vertical direction V in the lateral direction L). According to an alternative embodiment illustrated in FIGS. 5 and 6, base plate 244 is mounted to a back side of appearance panel 212 and heat exchange fins 242 extend substantially along a horizontal direction (e.g., as defined by the lateral direction L in the transverse direction T).

Figure 4:
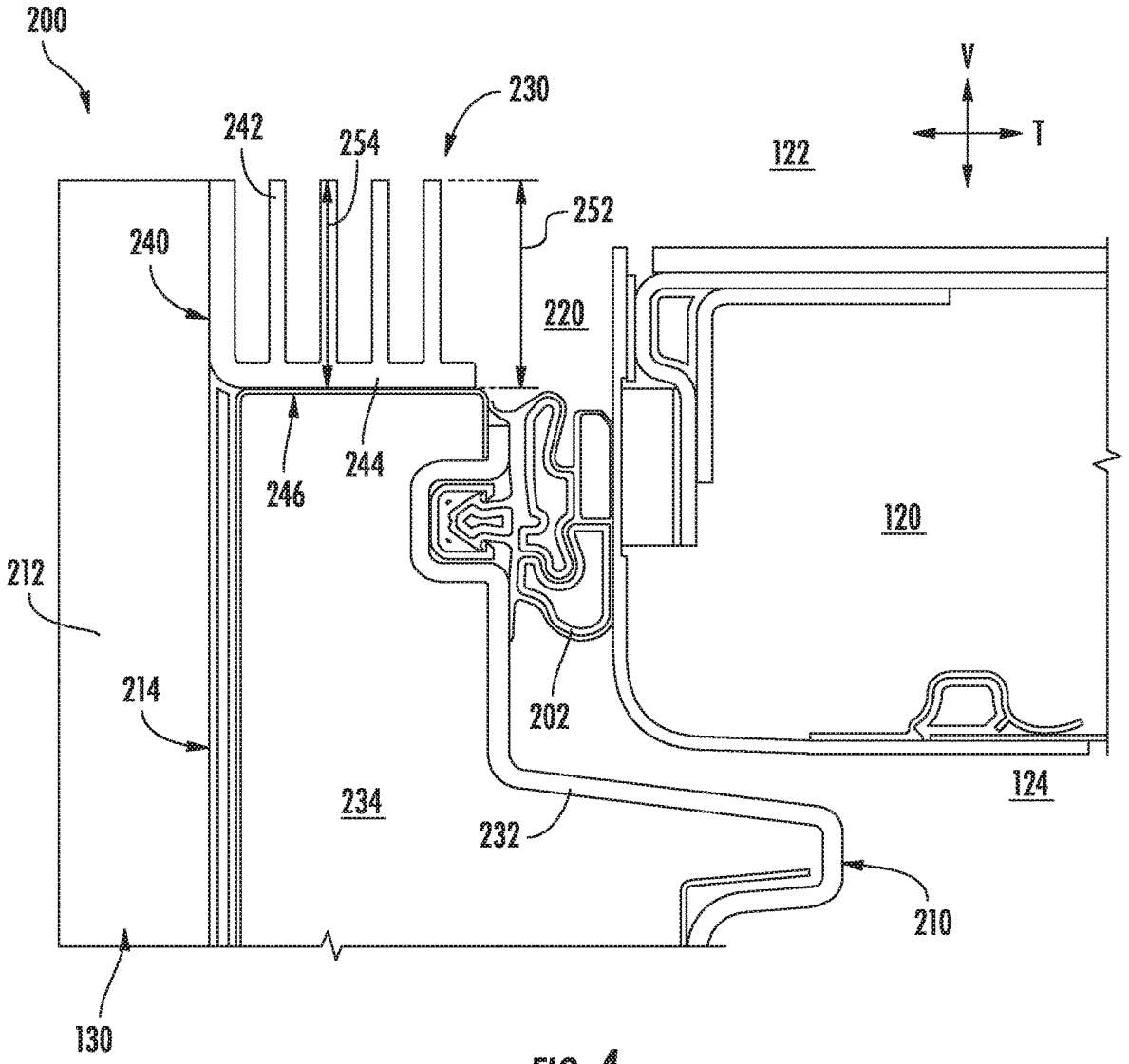
FIG. 4 provides a close-up section view of the exemplary door assembly of FIG. 3 according to an exemplary embodiment of the present subject matter.
Figure 6:
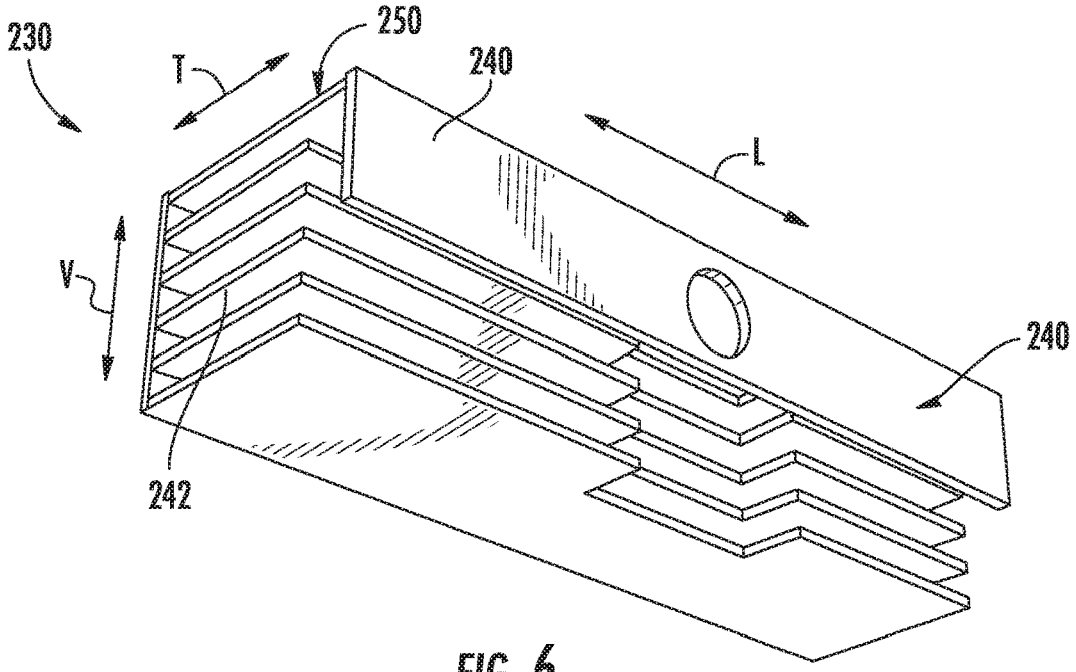
FIG. 6 provides a perspective view of the exemplary heat transfer feature of FIG. 5 according to an exemplary embodiment of the present subject matter.

Regardless of the orientation of heat exchange fins 242, heat sink 240 may generally be in thermal contact with door frame 210 to improve heat transfer into air pocket 220. For example, as illustrated, heat sink 240 may define a substantially square cross-section within a plane defined by the vertical direction V and the transverse direction T. In this manner, as best shown in FIG. 6, heat sink 240 may define a top surface 250 that extends within a horizontal plane H and conceals heat exchange fins 242 from a user opening door assembly 200. Notably, top surface 250 also prevents spills and other debris from falling into heat exchange fins 242. As best shown in FIG. 4, appearance panel 212 may extend past mounting surface 246 by an extension height 252 and heat sink 240 may define a feature height 254. According to exemplary embodiments, extension height 252 is substantially equivalent to feature height 254 so that a flush surface is formed. Alternatively, feature height 254 may be any other suitable size, e.g., less than extension height 252.

Notably, the number, size, position, angle, geometry, and material of heat exchange fins 242 may vary while remaining within the scope of the present subject matter. For example, according to the illustrated embodiment, heat sink 240 includes between three and ten heat exchange fins 242 but could alternatively include any other suitable number of heat exchange fins 242. In addition, according to the illustrated embodiment, heat exchange fins 242 may define a height to width ratio of between about 2 and 20, between about 4 and 15, between about 6 and 12, or greater than 10. In addition, heat exchange fins 242 may further extend at different angles, may have surface texture for improving heat transfer, and may be made out of any suitable material. For example, heat sink 240 may be brushed and anodized for a smooth appearance. Other suitable heat exchange features 230 are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet;

a liner positioned within the cabinet to define a chilled chamber;

a door mounted to the cabinet and being movable between an open position and a closed position to provide selective access to the chilled chamber, wherein the door comprises an insulated door frame and an appearance panel mounted to a front of the insulated door frame;

an air pocket defined between the door and the liner; and a heat transfer feature mounted to both the insulated door frame and the appearance panel within the air pocket for increasing a surface area for thermal energy transfer.

2. The refrigerator appliance of claim 1, further comprising:

a mullion positioned within the liner to divide the chilled chamber into a fresh food chamber and a freezer chamber, wherein the door is a fresh food door; and a freezer door mounted to the cabinet and being movable between an open position and a closed position to provide selective access to the freezer chamber, wherein the air pocket is defined at least in part between the fresh food door, the freezer door, and the mullion.

3. The refrigerator appliance of claim 2, further comprising:

a gasket positioned between the door and the liner and the mullion.

4. The refrigerator appliance of claim 1, wherein the heat transfer feature is a heat sink defining a plurality of heat exchange fins.

5. The refrigerator appliance of claim 4, wherein the heat sink is formed from stainless steel or aluminum.

6. The refrigerator appliance of claim 4, wherein the heat exchange fins extend within a horizontal plane.

7. The refrigerator appliance of claim 4, wherein the heat exchange fins extend within a vertical plane.

8. The refrigerator appliance of claim 4, wherein each of the heat exchange fins defines a height to width ratio of greater than 10.

9. The refrigerator appliance of claim 1, wherein the heat transfer feature extends along an entire width of both a top and a bottom of the door.

10. The refrigerator appliance of claim 1, wherein the heat transfer feature is brushed and anodized.

11. The refrigerator appliance of claim 1, wherein the appearance panel is constructed from wood.

12. The refrigerator appliance of claim 1, wherein the appearance panel extends past a mounting surface of the insulated door frame by an extension height, and wherein the heat transfer feature is mounted to the mounting surface and defines a feature height substantially equivalent to the extension height.

13. A door assembly and a refrigerator appliance, the refrigerator appliance comprising a liner defining a chilled chamber, the door assembly comprising:

an insulated door frame mounted to the refrigerator appliance and being movable between an open position and a closed position to provide selective access to the chilled chamber;

an appearance panel mounted to a front of the insulated door frame and extending past a mounting surface of the insulated door frame by an extension height;

an air pocket defined between the appearance panel, the insulated door frame, and the liner; and a heat transfer feature positioned within the air pocket and comprising heat exchange fins for increasing a surface area for thermal energy transfer, wherein the heat transfer feature is mounted to the mounting surface and defines a feature height substantially equivalent to the extension height.

14. The door assembly of claim 13, wherein the heat exchange fins are formed from stainless steel or aluminum.

15. The door assembly of claim 13, wherein the heat exchange fins extend along a horizontal direction.

16. The door assembly of claim 13, wherein the heat exchange fins extend along a vertical direction.

17. The door assembly of claim 13, wherein each of the heat exchange fins defines a length to width ratio of greater than 10.

18. A refrigerator appliance defining a vertical direction, a lateral direction, and a transverse direction, the refrigerator appliance comprising:

a cabinet;

a liner positioned within the cabinet to define a chilled chamber;

a door mounted to the cabinet and being movable between an open position and a closed position to provide selective access to the chilled chamber;

an air pocket defined between the door and the liner; and a heat transfer feature positioned within the air pocket for increasing a surface area for thermal energy transfer wherein the heat transfer feature is brushed and anodized.

* * * * *